US006715584B2

(12) United States Patent
Ostyn

(10) Patent No.: US 6,715,584 B2
(45) Date of Patent: Apr. 6, 2004

(54) ESCAPE LADDER

(76) Inventor: Valere R. Ostyn, 33640 Annapolis St., Wayne, MI (US) 48184-2900

( * ) Notice: Subject to any disclaimer, the term of this patent is extended or adjusted under 35 U.S.C. 154(b) by 0 days.

(21) Appl. No.: 10/212,020

(22) Filed: Aug. 5, 2002

(65) Prior Publication Data

US 2004/0020714 A1 Feb. 5, 2004

(51) Int. Cl.[7] ..... E06C 9/00; E06C 1/00
(52) U.S. Cl. ..... 182/96; 182/160
(58) Field of Search ..... 182/96, 98, 95, 182/159, 93, 160

(56) References Cited

U.S. PATENT DOCUMENTS

| | | | | |
|---|---|---|---|---|
| 356,591 A | | 1/1887 | Larkin | |
| 896,295 A | | 8/1908 | Haines | |
| 4,049,080 A | | 9/1977 | Suzuki | |
| 4,243,119 A | * | 1/1981 | Rossey, Sr. | 182/96 |
| 4,463,829 A | * | 8/1984 | Grin | 182/160 |
| 4,531,613 A | | 7/1985 | Keigher | |
| 4,766,525 A | | 8/1988 | Loughlin | |
| D350,416 S | | 9/1994 | Doiron | |
| 5,377,778 A | | 1/1995 | Lan | |
| 5,628,380 A | | 5/1997 | Matisi | |
| 6,536,558 B2 | * | 3/2003 | Price | 182/162 |

* cited by examiner

*Primary Examiner*—Hugh B. Thompson, II
(74) *Attorney, Agent, or Firm*—Donald R. Schoonover

(57) ABSTRACT

An escape ladder includes a first leg that is attached to a support surface, such as an outside wall of a building, and a second leg that is movable with respect to the first leg. Rungs are movably attached to the first leg and to the second leg and move between a deployed orientation extending outwardly from the first leg to a stored orientation extending along the long axis of the first leg. The legs and the rungs are rigid.

1 Claim, 3 Drawing Sheets

ESCAPE LADDER

BACKGROUND OF THE INVENTION

1. Field of the Invention

The present invention relates to the general art of ladders, and to the particular field of escape ladders.

2. Discussion of the Related Art

Many buildings and homes are more than one story tall. If a building is more than one story tall, it may be difficult to exit that building in the event of an emergency, such as a fire or the like. This problem is exacerbated as the height of the building increases. In some instances, people trapped on an upper floor of a burning building are unable to escape because rescue equipment cannot reach them and they are not able to reach escape routes.

Some escape routes require a person to pass through a hallway or the like which may be blocked by smoke or fire. Sometimes, people panic and lose their way to such escape routes.

Therefore, there is a need for an escape ladder that is located for easy access.

The ladder art contains many examples of escape ladders that can be located adjacent to windows and outside doors. However, many of these known escape ladders are difficult to deploy. For example, some ladders must be taken out of storage, moved to a window or outside access port, and then deployed. A rope ladder stored in a container near a window is an example of such prior art escape ladders. If a person is fleeing for their life, it would be reasonable to believe that they will not be thinking clearly enough to accomplish any but the most simple tasks. Thus, requiring a person to open a container, move a ladder to an escape port and then deploy that ladder may be expecting too much. Even if the ladder is located closely adjacent to the escape portal, it may be asking too much to require a person who is in fear for their life to manipulate such an escape ladder unit. Furthermore, if there is a fire in the room, a person may be extremely reluctant to re-enter the room, even to obtain an escape ladder.

Therefore, there is a need for an escape ladder that is easily deployed.

Many escape ladders, especially rope ladders, are very unstable once deployed. This makes it difficult for a person, especially an elderly or infirm person who may be in a panic, to stay on such a ladder. For this reason, some people may avoid using a ladder even after it is deployed. This is especially true if the escape is being attempted from a great height. Fear of heights may prevent such a person from using a ladder, and such fear will be exacerbated if the ladder appears to be unsteady.

Therefore, there is a need for an escape ladder that is stable and easy to use once deployed.

Many building designers take aesthetics into account and may even subordinate some functions to the form of the building. An escape ladder that interferes with building aesthetics may be changed or even deleted if possible. A building designer may even seek another form of escape to maintain desired building aesthetics.

Therefore, there is a need for an escape ladder that is unobtrusive when it is in a stored condition.

PRINCIPAL OBJECTS OF THE INVENTION

It is a main object of the present invention to provide an escape ladder that is located for easy access.

It is another object of the present invention to provide an escape ladder that is easily deployed.

It is another object of the present invention to provide an escape ladder that is stable once deployed.

It is another object of the present invention to provide an escape ladder that is easy to use.

It is another object of the present invention to provide an escape ladder that is unobtrusive when in a stored condition.

SUMMARY OF THE INVENTION

These, and other, objects are achieved by an escape ladder which comprises a first rigid leg fixedly secured to a support member when in use and having an axial extent; a plurality of rigid rungs movably attached to the first leg to move between a first orientation extending in the direction of the axial extent of the first leg and a second orientation that extends outwardly from the first leg; a second rigid leg fixedly secured to the rungs to move therewith between a first position closely adjacent to the first leg when the rungs are in the first orientation and a second position spaced apart from the first leg when the rungs are in the second orientation. The rungs are interposed between the first leg and the second leg.

The escape ladder embodying the present invention can be fixed to the outside wall of a building just beneath a window or other easily accessed building element and can reach to the ground or to a safety platform. The second leg of the ladder can be locked to the first leg so the closed ladder is unobtrusive and may even be worked into the aesthetic appearance of some buildings, yet can be easily reached and, once reached, easily deployed, and once deployed, easily and safely used. The rungs are rigid and the legs of the ladder are also rigid whereby the deployed ladder is secure so a person will feel secure while using the ladder. Both the rungs and the legs of the ladder can be made of sturdy material, such as metal or the like.

BRIEF DESCRIPTION OF THE DRAWING FIGURES

DETAILED DESCRIPTION OF THE INVENTION

Figure 1:
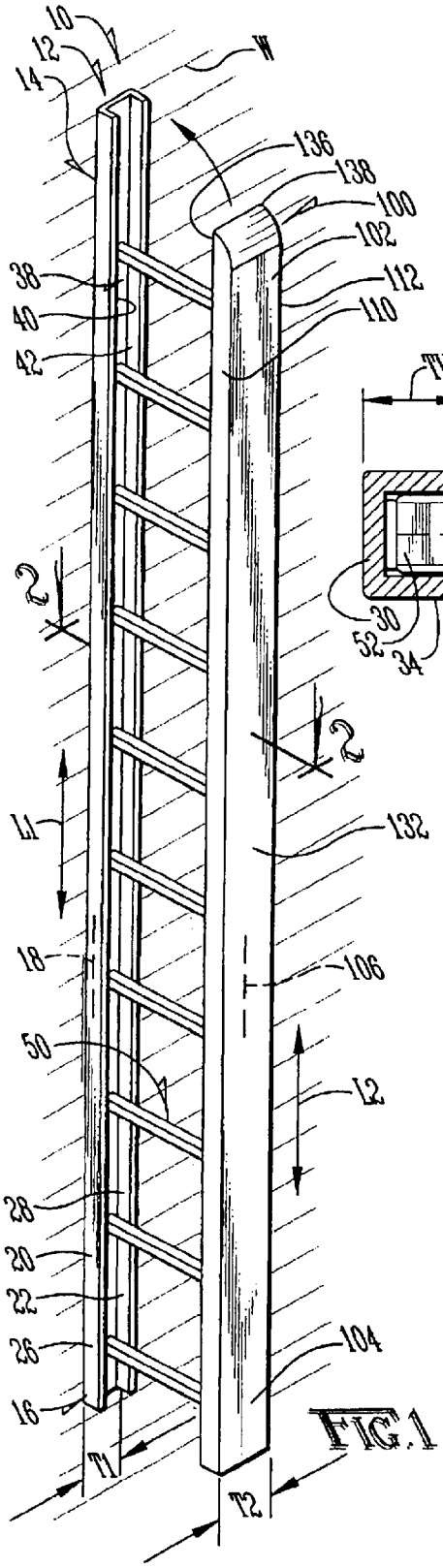
FIG. 1 is a perspective view of an escape ladder embodying the present invention in a deployed condition.
Figure 2:
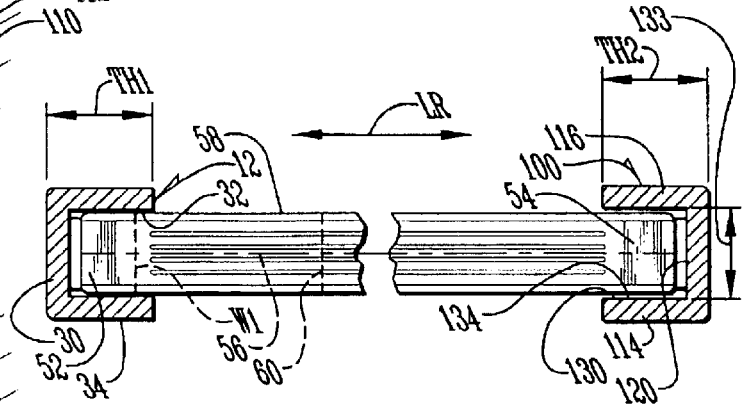
FIG. 2 is a view taken along line 2—2 of FIG. 1.

Other objects, features and advantages of the invention will become apparent from a consideration of the following detailed description and the accompanying drawings.

The escape ladder embodying the present invention is usually located on the outside of a building just beneath an exit portal of the building, such as a window. The escape ladder is unobtrusive when it is in the stored condition, yet is easily accessed and easily deployed into a stable escape route once access is gained to the escape portal. Since most people will naturally seek an exit port in an emergency situation, the location of the escape ladder of the present invention next to such location will enhance the ability of the ladder to achieve its main objective of providing an easily reached escape path and an easily deployed escape path from a building. The ladder can be locked so it cannot be used by an intruder to gain access to the building via the exit port.

Referring to the Figures, it can be understood that the present invention is embodied in an emergency escape ladder 10 which comprises a first leg 12 having a first end 14 that will be situated beneath an exit port of a building, such as beneath a window or the like when ladder 10 is in the deployed condition, a second end 16 which will be located near the ground or near a platform when ladder 10 is in the deployed condition, a longitudinal dimension 18 extending between the first end 14 of first leg 12 and the second end 16 of first leg 12. A length dimension L1 is measured along the longitudinal dimension 18 of the first leg 12 from the first end 14 of the first leg 12 to the second end 16 of the first leg 12. First leg 12 also includes a first side 20, a second side 22, a transverse dimension T1 extending from the first side 20 to the second side 22 of the first leg 12.

The first leg 12 is formed of rigid material, such as fireproof metal or the like and is colored to fit into the aesthetics of a building. First leg 12 of ladder 10 is fixedly mounted on the outside surface of a support, such as a wall W, or the like, and is U-shaped in transverse cross section. First leg 12 further includes a first arm 26 adjacent to the first side 20 of first leg 12, a second arm 28 adjacent to the second side 22 of first leg 12 and a bight section 30 connecting first arm 26 of the first leg 12 to second arm 28 of first leg 12. An inner surface 32 is located on first arm 26 and on second arm 28 and on bight section 30 of first leg 12, and an outer surface 34 is located on first arm 26 and on second arm 28 and on bight section 30 of first leg 12. A width dimension W1 is measured from the inner surface 32 of the first arm 26 of first leg 12 to the inner surface 32 of the second arm 28 of first leg 12 along the transverse dimension of first leg 12. A channel 38 is defined by the inner surface 32. A first rim 40 is located on the first arm 26 of first leg 12 and a second rim 42 is located on the second arm 28 of first leg 12. A thickness dimension TH1 is measured between the first rim 40 of the first arm 26 of first leg 12 to the bight section 30 of the first leg 12.

The portion of outer surface 34 that is on the bight section 30 of first leg 12 is fixedly attached to the support surface so the first leg 12 is oriented with the thickness dimension extending outwardly away from the support surface.

A plurality of identical rungs, such as rung 50, are attached to first leg 12 at locations that are spaced apart from each other in the direction of the longitudinal axis 18 of first leg 12. Each rung 50 includes a first end 52, a second end 54, and a longitudinal axis 56 extending between the first end 52 of each rung 50 and the second end 54 of each rung 50. A length dimension LR is measured along the longitudinal axis 56 of each rung 50 from the first end 52 of each rung 50 to the second end 54 of each rung 50. Each rung 50 further includes an outer surface 58 and an outer dimension 60. In the case of a cylindrical rung, outer dimension 60 is an outer diameter. The outer dimension 60 of each rung 50 is smaller than the width dimension of first leg 12 so the rungs 50 can be accommodated in the channel 38 defined in the first leg 12 as will be understood from the teaching of the present disclosure.

A hinge unit 61 hingeably connects each rung 50 to the inner surface 32 of first leg 12 adjacent to the bight section 30 of first leg 12. All of the hinge units 61 are identical and each hinge unit 61 includes an L-shaped plate 62 having a first leg section 64, a second leg section 66 and a corner 68 which connects first leg section 64 to second leg section 66 at a right angle. A first surface 70 and a second surface 72 are located on first leg section 64 of L-shaped plate 62, and first leg section 64 includes a first end 74 and a second end 76. First surface 70 on the first leg section 64 of L-shaped plate 62 of each hinge unit 61 is fixedly mounted on inner surface 32 of first leg 12 adjacent to the bight section 30 of first leg 12 and second leg section 66 extends outwardly from the inner surface 32 of first leg 12 adjacent to the bight section 30 of first leg 12. Second leg section 66 includes a first end 78 and a second end 80. Second end 80 of second leg section 66 is spaced apart from the inner surface 32 of first leg 12 adjacent to the bight section 30 of the first leg 12. A second plate 82 has a first surface 84, a second surface 86, a first end 88 and a second end 90.

A hinge coupling 92 hingeably connects second end 80 of second leg section 66 of the L-shaped plate 62 of each hinge unit 61 to first end 88 of second plate 82 of each hinge unit 61. It is noted that second end 80 and first end 88 may be in abutting contact with each other and first surface 94 of second leg section 66 is co-planar with first surface 84 of second plate 82 in the position shown in FIG. 6.

Figure 6:
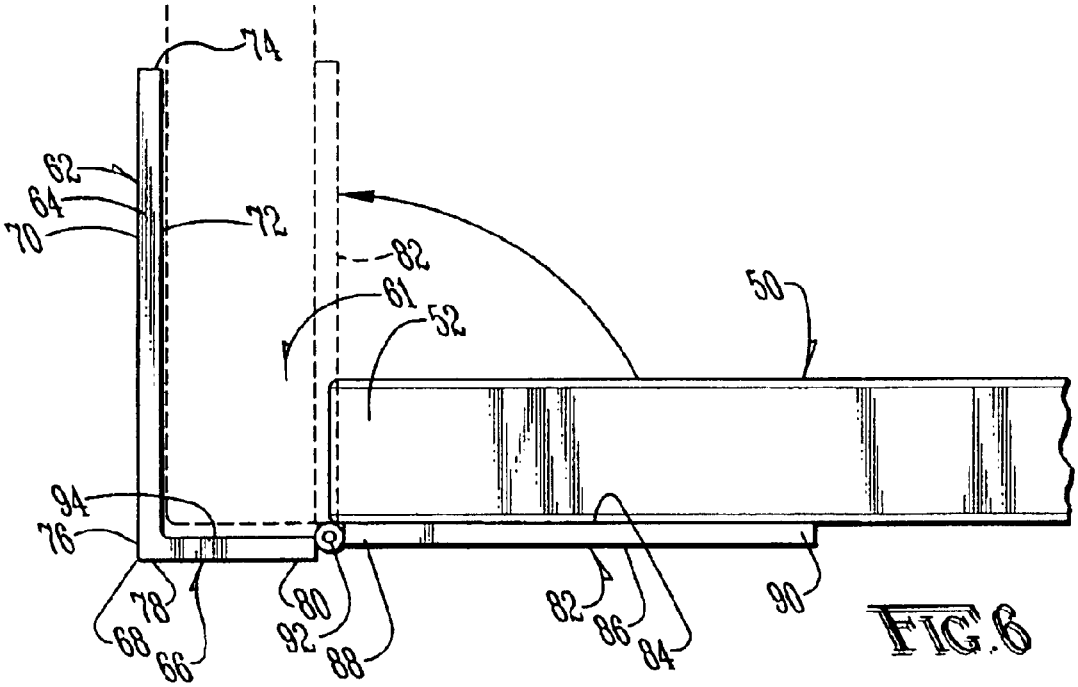
FIG. 6 is a side elevational view of a hinge unit used in the escape ladder embodying the present invention.

Each hinge unit 61 is movable between a first orientation shown in solid lines in FIG. 6 in which first surface 84 of second plate 82 is co-planar with first surface 94 of second leg section 66 of L-shaped plate 62 and extends outwardly therefrom and a second orientation indicated in FIG. 6 in dotted lines, in which second plate 82 of each hinge unit 61 is oriented at a right angle with respect to second leg section 66 of L-shaped plate 62.

Escape ladder 10 further includes a second leg 100 which includes a first end 102, a second end 104, a longitudinal dimension 106 of second leg 100 extending between first end 102 of second leg 100 and second end 104 of second leg 100 and a length dimension L2 measured along the longitudinal dimension 106 of second leg 100 from first end 102 to the second end 104. Second leg 100 further includes a first side 110, a second side 112, a transverse dimension T2 which extends from first side 110 of second leg 100 to second side 112 of second leg 100.

Second leg 100 is U-shaped in transverse cross section and further includes a first arm 114 located adjacent to first side 110 of second leg 100 and a second arm 116 which is located adjacent to second side 112 of second leg 100. A bight section 120 connects first arm 114 of second leg 100 to second arm 116 of second leg 100. Second leg 100 further includes an inner surface 130 on first arm 114 and on second arm 116 and on bight section 120 of second leg 100. An outer surface 132 is on first arm 114 and on second leg 100 and on second arm 116 of second leg 100 and on bight section 130 of second leg 100.

A width dimension 133 is measured from the inner surface 130 of first arm 114 to the inner surface of second arm 116 of second leg 100 along the transverse dimension of the,second leg. A channel 134 is defined by the inner surface of the second leg. A first rim 136 is positioned on first arm 114 of second leg 100 and a second rim 138 is positioned on the second arm 116 of second leg 100. A thickness dimension TH2 is measured between first rim of first leg to bight section 120 of second leg 100.

First leg 12 is interposed between second leg 100 and support surface W.

Figure 7:
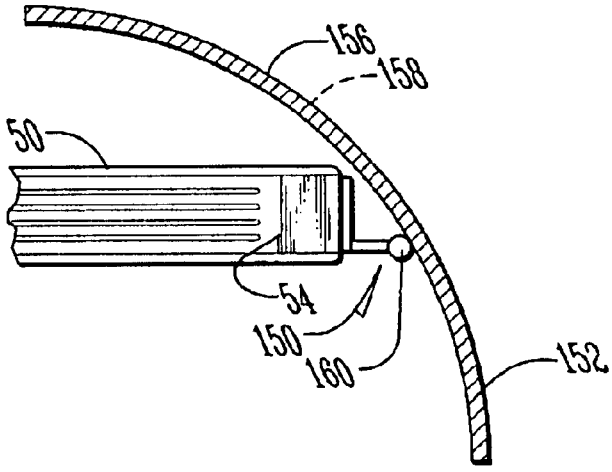
FIG. 7 is a side elevational view of a hinge that connects one end of a rung of the ladder of the present invention to one of the legs of the ladder.

The second end of each rung 50 is attached to the inner surface 130 of second leg 100 adjacent to the bight section 120 of the second leg 100 and the rungs 50 are interposed between the first leg 12 and the second leg 100. The outer dimension 60 of each rung 50 is less than the width dimension of the first leg 12 so the rungs 50 can be accommodated in the channel 38 defined in the first leg when the ladder 10 is in a stored condition. The width dimension of the first leg 12 is equal to the width dimension of the second leg 100 so the ladder 10 will be neatly stored and aesthetically pleasing when it is in the stored condition. A joint 150 is shown in FIG. 7 and connects the end of a rung 50 to leg 100 so the leg and the rung can move as described herein. There is a joint 150 associated with each rung 50. Each joint 150 includes a first leg 152 fixedly connected to the second leg 100 and an arcuate body 156 having a channel 158 defined therein. A pin 160 extends from second end 54 of the rung 50 associated with the joint 150 and slides in the channel 158. The channel 158 is sized and shaped so the rung 50 can slide therein between the first and second positions thereof as discussed herein. It is also noted that an arcuate joint identical to the just-described joint 150 can be substituted for the above-described hinge units 61 in some circumstances. Such a joint unit 150 will be sized and shaped to permit the rungs 50 and ladder legs 12, 100 to move as described herein. It is further noted that joint elements 150 can be substituted for the hinge units 61 as well and will be sized and shaped to permit the legs 12, 100 and rungs 50 to move as described herein.

Figure 3:
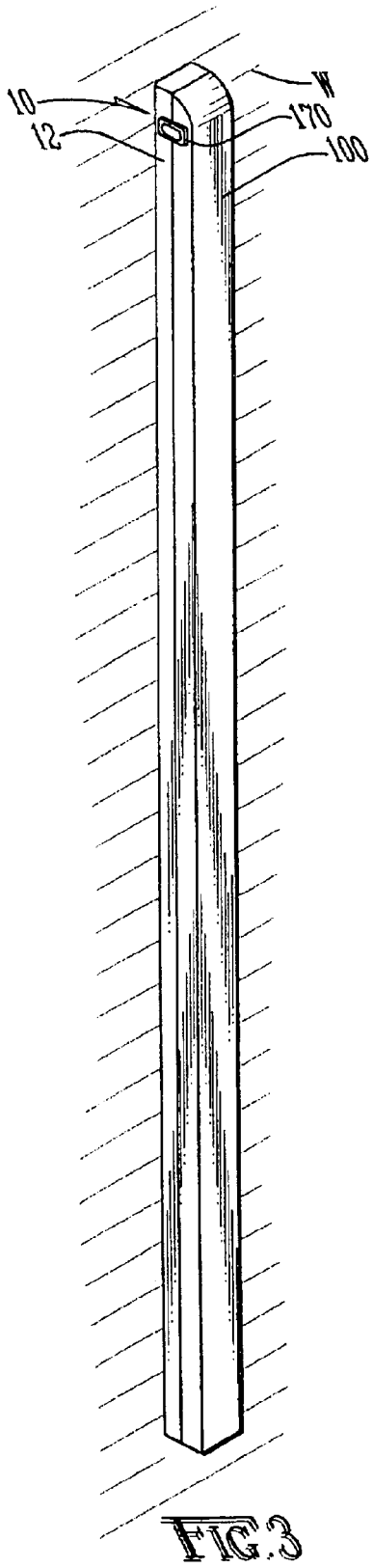
FIG. 3 is a perspective view of an escape ladder embodying the present invention in a stored condition.
Figure 4:
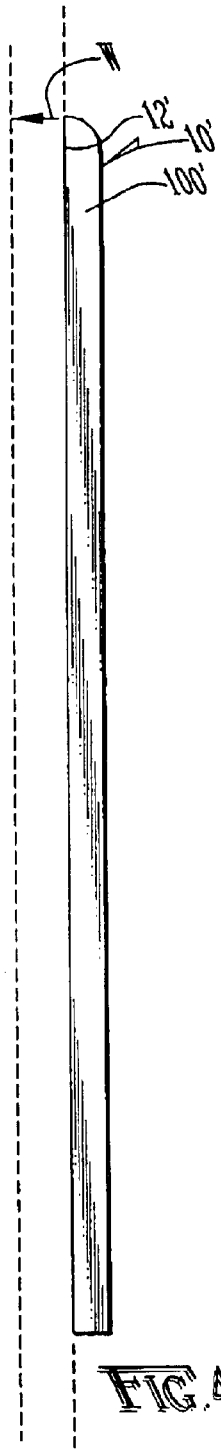
FIG. 4 is a front elevational view of an escape ladder embodying the present invention in a stored condition.
Figure 5:
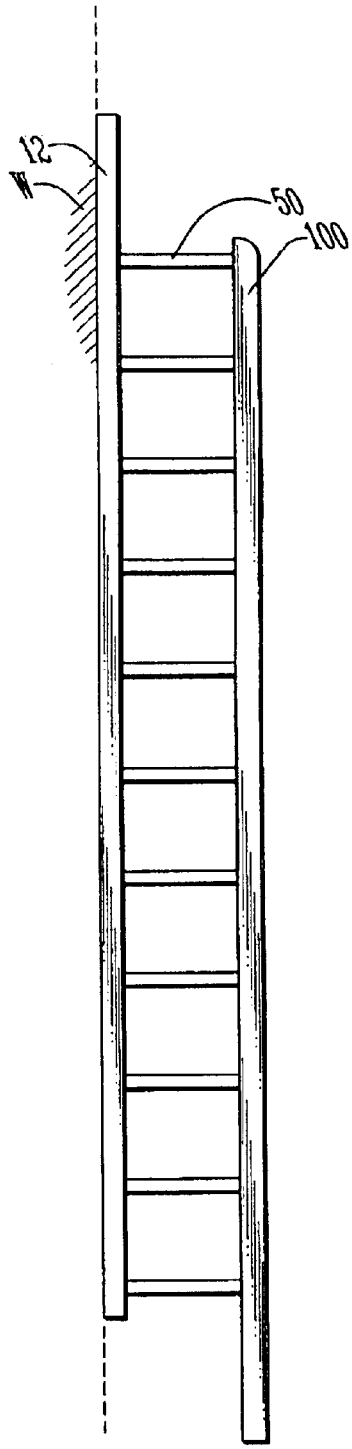
FIG. 5 is a front elevational view of an escape ladder embodying the present invention in a deployed condition.

Second leg 100 is movable with the rungs 50 between a first position shown in FIGS. 1 and 5 which corresponds to the first orientation of each hinge unit 61 as shown in full lines in FIG. 6 in which first end 102 of second leg 100 is congruent with first end 14 of first leg 12 and second end 104 of second leg 100 is congruent with second end 16 of first leg 12 and in which first rim 136 of second leg 100 is in abutting contact with first rim 40 of first leg 12 and second rim 138 of second leg 100 is in abutting contact with second rim 42 of first leg 12 and rungs 50 are located in the channels on the first and second legs, and a second position shown in FIGS. 3 and 4, corresponding to the second orientation of each hinge unit 61 as indicated in FIG. 6 in dotted lines and which is shown in FIG. 3, in which first end 102 of second leg 100 is spaced apart from first end 14 of first leg 12 in the direction of the longitudinal axis of first leg 12 and second end 104 of second leg 100 is spaced apart from second end 16 of first leg 12 in the direction of the longitudinal axis of first leg 12 and first rim 136 of second leg 100 is spaced apart from first rim 40 of first leg 12 in the direction of the thickness dimension of first leg 100.

A lock 170 is located on the first ends of each of the legs to lock the first leg to the second leg when the ladder is in the stored condition. This prevents a would-be intruder from deploying the ladder from below to gain access to the inside of a building through an exit port, such as a window, or the like. The lock 170 can be an over-the-center type lock that is easily opened when necessary, even by someone who is in a panic, yet is securely closed when desired.

One form of the ladder has the channel in second leg 100 wider than the channel in first leg 12 whereby the second leg will cover the first leg when the ladder is in the stored condition. This will make the ladder even less obtrusive when it is stored. This form of the ladder is shown in FIG. 4 as ladder 10' having leg 100' covering leg 12'. Such a ladder will have a dimension of only three to four inches away from the wall when the ladder is being stored. Thus a ladder that can be eight to ten feet long will be stored in a configuration that is very narrow with respect to the structure on which it is attached.

It is understood that while certain forms of the present invention have been illustrated and described herein, it is not to be limited to the specific forms or arrangements of parts described and shown.

What is desired to be covered by Letters Patent is:

1. An emergency escape ladder comprising:

a) a first leg having
(1) a first end,
(2) a second end,
(3) a longitudinal dimension extending between the first end of said first leg and the second end of said first leg,
(4) a length dimension measured along the longitudinal dimension of said first leg from the first end of said first leg to the second end of said first leg,
(5) a first side,
(6) a second side,
(7) a transverse dimension extending from the first side of said first leg to the second side of said first leg, b) said first leg being U-shaped in transverse cross section and further including
(1) a first arm adjacent to the first side of said first leg,
(2) a second arm adjacent to the second side of said first leg,
(3) a bight section connecting the first arm of said first leg to the second arm of said first leg,
(4) an inner surface on the first arm and on the second arm and on the bight section of said first leg,
(5) an outer surface on the first arm and on the second arm and on the bight section of said first leg,
(6) a width dimension measured from the inner surface on the first arm of said first leg to the inner surface on the second arm of said first leg along the transverse dimension of said first leg,
(7) a channel being defined by the inner surface, and
(8) a first rim on the first arm of said first leg,
(9) a second rim on the second arm of said first leg, and
(10) a thickness dimension measured between the first rim on the first arm of said first leg to the bight section of said first leg;

c) the outer surface on the bight section of said first leg being fixedly attached to a support surface;

d) a plurality of rungs attached to said first leg at locations that are spaced apart from each other in the direction of the longitudinal axis of said first leg, each rung including
(1) a first end,
(2) a second end,
(3) a longitudinal axis extending between the first end of each rung and the second end of each rung,
(4) a length dimension measured along the longitudinal axis of each rung from the first end of each rung to the second end of each rung,
(5) an outer surface on each rung, and
(6) an outer dimension;

d) the outer dimension of each rung being smaller than the width dimension of said first leg;

e) a hinge unit hingeably connecting each rung to the inner surface of said first leg adjacent to the bight section of said first leg, each hinge unit including
(1) an L-shaped plate having a first leg section, a second leg section, a corner connecting the first leg section to the second leg section at a right angle, the first leg section including a first surface, a second surface, a first end and a second end, with the first surface on the first leg section of the L-shaped plate of each hinge unit being fixedly mounted on the inner surface of said first leg adjacent to the bight section of said first leg and the second leg section of the L-shaped plate extending outwardly from the inner surface of said first leg adjacent to the bight section of said first leg, the second leg section of the L-shaped plate including a first surface, a second surface, a first end and a second end, with the second end of the second leg section of the L-shaped plate being spaced apart from the inner surface of said first leg adjacent to the bight section of said first leg, (2) a second plate having a first surface, a second surface, a first end and a second end, (3) a hinge coupling hingeably connecting the second end of the second leg section of the L-shaped plate of each hinge unit to the first end of the second plate of each hinge unit;

f) each hinge unit being movable from a first orientation in which the first surface of the second plate is co-planar with the first surface of the second leg of the L-shaped plate and extends outwardly therefrom and a second orientation in which the second plate of each hinge unit is oriented at a right angle with respect to the second leg section of the L-shaped plate;

g) a second leg (1) a first end, (2) a second end, (3) a longitudinal dimension of said second leg extending between the first end of said second leg and the second end of said second leg, (4) a length dimension measured along the longitudinal dimension of said second leg from the first end of said second leg to the second end of said second leg, (5) a first side, (6) a second side, (7) a transverse dimension extending from the first side of said second leg to the second side of said second leg, h) said second leg being U-shaped in transverse cross section and further including (1) a first arm adjacent to the first side of said second leg, (2) a second arm adjacent to the second side of said second leg, (3) a bight section connecting said first arm of said second leg to the second arm of said second leg, (4) an inner surface on the first arm of said second leg and on the second arm and on the bight section of said second leg, (5) an outer surface on the first arm of said second leg and on the second arm of said second leg and on the bight section of said second leg, (6) a width dimension measured from the inner surface on the first arm of said second leg to the inner surface on the second arm of said second leg along the transverse dimension of said second leg, (7) a channel being defined by the inner surface of said second leg, and (8) a first rim on the first arm of said second leg, (9) a second rim on the second arm of said second leg, and

(10) a thickness dimension measured between the first rim on the first leg of said second leg to the bight section of said second leg;

i) said first leg being interposed between said second leg and said support surface;

j) a plurality of joints mounted on the inner surface of said second leg, each joint being associated with a rung;

k) the second end of each rung being attached to one joint of said plurality of joints to be attached via the one joint to the inner surface of said second leg adjacent to the bight section of said second leg;

l) said plurality of rungs being interposed between said first leg and said second leg;

m) the outer dimension of each rung being less than the width dimension of said first leg, n) the width dimension of said first leg being equal to the width dimension of said second leg; and o) said second leg being movable with said rungs between a first position corresponding to the first orientation of each hinge unit in which the first end of said second leg is congruent with the first end of said first leg and the second end of said second leg is congruent with the second end of said first leg and in which the first rim of said second leg is in abutting contact with the first rim of said first leg and the second rim of said second leg is in abutting contact with the second rim of said first leg and said rungs are located in the channels on said first and second legs, and a second position corresponding to the second orientation of each hinge unit in which the first end of said second leg is spaced apart from the first end of said first leg in the direction of the longitudinal axis of said first leg and the second end of said second leg is spaced apart from the second end of said first leg in the direction of the longitudinal axis of said first leg and the first rim of said second leg is spaced apart from the first rim of said first leg in the direction of the direction of the thickness dimension of said first leg.

* * * * *